US005950544A

United States Patent [19]

Bieker

[11] Patent Number: 5,950,544

[45] Date of Patent: Sep. 14, 1999

[54] RAIL VEHICLE

[75] Inventor: Guido Bieker, Kirchhunden, Germany

[73] Assignee: ABB Daimler-Benz Transportation (Technology) GmbH, Berlin, Germany

[21] Appl. No.: 09/098,299

[22] Filed: Jun. 16, 1998

Related U.S. Application Data

[63] Continuation of application No. PCT/EP97/05630, Oct. 11, 1997.

[30] Foreign Application Priority Data

Oct. 16, 1996 [DE] Germany ..... 196 42 678

[51] Int. Cl.[6] ..... B61F 5/00

[52] U.S. Cl. ..... 105/453; 105/199.3

[58] Field of Search ..... 105/199.1, 199.3, 105/453; 267/122, 3

[56] References Cited

U.S. PATENT DOCUMENTS

| | | | |
|---|---|---|---|
| 3,343,830 | 9/1967 | Dean et al. | 267/3 |
| 3,361,087 | 1/1968 | Dean | 105/199.1 |
| 3,580,557 | 5/1971 | Dean | 105/199.1 |
| 3,904,181 | 9/1975 | Harsy-Vadas | 267/3 |

FOREIGN PATENT DOCUMENTS

| | | | |
|---|---|---|---|
| 301304 | 2/1989 | European Pat. Off. | 105/453 |
| 2218378 | 10/1973 | Germany | 267/3 |
| 2502991 | 9/1975 | Germany | 267/3 |
| 2711348 | 8/1978 | Germany | 105/199.1 |

*Primary Examiner*—Mark T. Le

*Attorney, Agent, or Firm*—Herbert L. Lerner; Laurence A. Greenberg

[57] ABSTRACT

A rail vehicle, includes an air-suspended body having an underside, an air spring having a base point and an internal air pressure, and cars supporting the body. The body rests on the cars and swings out on the air spring. There is also an emergency spring which has a core. Guide and damping devices are further disposed between the body and the cars. The guide and damping devices serve to stabilize the cars at traveling speeds of >100 km/h and suppress any sway of the cars. The guide and damping devices include a friction plate loaded against the underside of the body by the internal air pressure of the air spring. The friction plate is linked to the core of the emergency spring or the base point of the air spring to form a connection to the cars in a longitudinal direction for suppressing the sway of the cars.

9 Claims, 1 Drawing Sheet

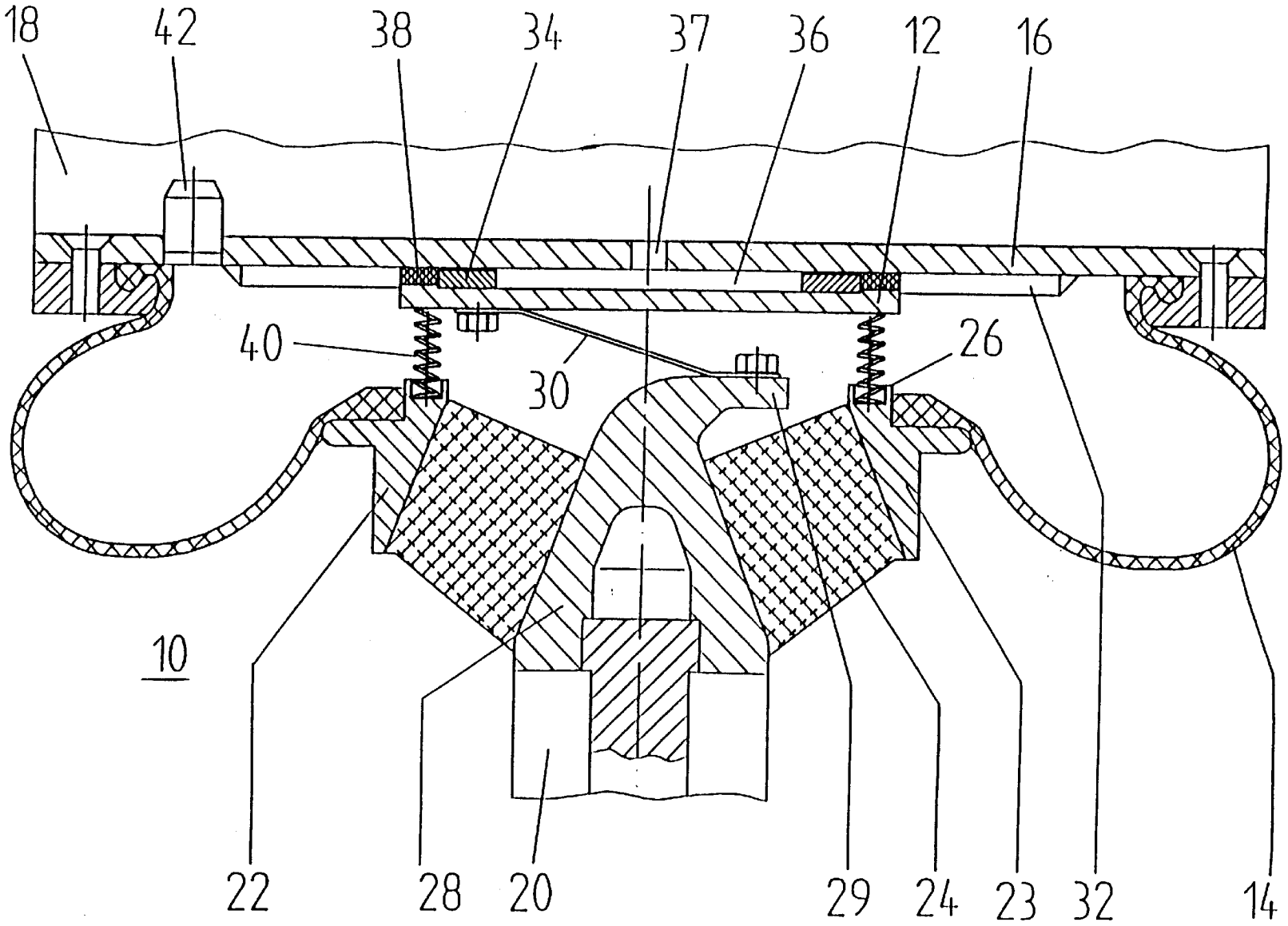
14
32
23
24
29
20
28
22
10
16
12
36
37
34
38
42
18
26
30
40

RAIL VEHICLE

CROSS-REFERENCE TO RELATED APPLICATION

This application is a continuation of International Application Ser. No. PCT/EP97/05630, filed Oct. 11, 1997, which designated the United States.

BACKGROUND OF THE INVENTION

FIELD OF THE INVENTION

The invention relates to a rail vehicle having an air-suspended coach body, cars (bogies) on which the coach body rests, in particular bolsterless air-suspended cars, and air springs on which the coach body swings out on. The rail vehicle also has guide and damping devices disposed in each case between the coach body and the cars. The damping devices serve to stabilize the cars at traveling speeds of v >100 km/h and suppress the sway of the cars.

It is generally known that, as a result of the wave-like sequence of motions of the wheel sets guided in the cars, the cars are caused to sway as speed increases. Furthermore, it is known to provide oil-hydraulic sway dampers or alternatively friction plates disposed between the car and the associated coach body for stabilizing the cars.

Sway dampers are normally used in air-suspended, bolsterless cars where the coach body swings out on the air spring. The use of sway dampers for stabilizing cars is comparatively complicated and costly. In addition, sway dampers add to the weight of a rail vehicle. Furthermore, a failure analysis of the sway damping is always required. Therefore, sway dampers may require a single-redundant construction, that is, the dampers are to be provided in duplicate, and, in addition or as an alternative, possibly require continuous monitoring of the cars by appropriate sensor elements.

Depending on the type and the configuration of the cars, stabilization is required starting at traveling speeds of 100 to 120 km/h. As the speed increases, the stabilizing effect must increase, which in turn has an adverse effect on the tracking forces when traveling on curves. Therefore, stabilization should be provided only as necessary.

SUMMARY OF THE INVENTION

It is accordingly an object of the invention to provide a rail vehicle which overcomes the hereinafore-mentioned disadvantages of the heretofore-known products of this general type, in which a simple, space-saving and fail-safe configuration for stabilizing the cars and the bodies is taught. In addition, the configuration can be inexpensively retrofitted into existing bodies.

With the foregoing and other objects in view there is provided, in accordance with the invention, a rail vehicle, including: an air-suspended body which has an underside; an air spring having a base point and an internal air pressure; cars supporting the body, the body resting on the cars and swinging out on the air spring; an emergency spring having a core; and guide and damping devices disposed between the body and the cars for stabilizing the cars at traveling speeds of >100 km/h and suppressing any sway of the cars, the guide and damping devices include a friction plate loaded against the underside of the body by the internal air pressure of the air spring, the friction plate is linked to one of the core of the emergency spring and the base point of the air spring to form a connection to the cars in a longitudinal direction for suppressing the sway of the cars.

According to the invention, a friction plate is provided as a guide and damping device. The friction plate is pressed against the underside of the body via the internal air pressure of the air spring. The friction plate is linked to the core of an emergency spring or to the base point of the air spring and is thereby connected to the car (bogie) in the longitudinal direction in order to suppress the sway of the car.

In accordance with an added feature of the invention, if the body swings out, the underside of the body moves relative to the air spring bearing against the friction plate creating friction work, the friction work suppresses the swaying motion of the cars.

In accordance with another feature of the invention, there is a connecting strap functioning as a longitudinal carrier, the friction plate is connected in an articulated manner to the emergency spring in a transverse direction via the connecting strap. In this way, oscillation detuning in the transverse direction occurs and thus the transverse riding qualities are not affected.

In accordance with an additional feature of the invention, there is a vent opening disposed between the underside of the body and the friction plate.

In accordance with a further added feature of the invention, the vent opening ensures a full differential pressure between the internal air pressure of the air spring and an ambient air pressure resulting in a contact force between the friction plate and the body.

In accordance with a further additional feature of the invention, there is a sealing device disposed on the friction plate and bearing against the underside of the body for sealing off a gap space enclosed by the sealing device, the gap space is formed between the friction plate and the underside of the body. The leakage gap of the frictional plate, for example as a result of porosity due to aging or caused by mechanical wear or damage, is not critical in so far as this represents the failure of the air spring. For this case, provision is made in a further improvement of the invention for the body to rest on the emergency spring with the friction plate in between. Here, the total force of the weight acts on the friction plate, but sufficient friction force for the stabilizing is also available.

In accordance with yet a further added feature of the invention, if at least one of the air spring and the sealing device enclosing the friction plate fails, the body will rest on the emergency spring with the friction plate in between.

In accordance with yet another feature of the invention, there is an opposing spring for loading the friction plate against the underside of the body if at least one of the air spring and the emergency spring is relieved. The opposing spring, for example is a helical compression spring. The opposing spring does not have the task of increasing the contact force but serves to load the friction plate against the underside of the body if the air spring and/or the emergency spring is relieved and thus serves to provide an uninterrupted flow of force.

In accordance with a concomitant feature of the invention, the cars are bolsterless air-suspended cars.

Other features which are considered as characteristic for the invention are set forth in the appended claims.

Although the invention is illustrated and described herein as embodied in a rail vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The figure of the drawing is a cross-sectional view of guide and dampening devices beneath a coach body according to the invention.

DESCRIPTION OF THE PREFERRED EMBODIMENTS

Referring now to the figure of the drawing in detail there is shown a damping device 10 formed of a friction plate 12, which interacts with an air spring 14 and loads an underside 16 of a coach body 18. In the configuration according to the invention, the air spring 14 is formed of annular bellows and is connected on one end to a guide 22, 23. The guide 22, 23 is in turn disposed on an associated car or bogie 20. On the other end, the air spring 14 is connected to the underside 16 of the coach body 18 and the underside 16 of the coach body is provided with a wear-resistant coating. The guide 22 is configured as a supporting ring 23, which, by a preferably vulcanized-on, annular rubber spring 24, adjoins a supporting cone 28 disposed on the car 20 (not shown in any more detail) and at the same time serves as an emergency spring 26.

Integrally formed on a top end of the supporting cone 28 is a guide pilot 29. Adjoining the guide pilot 29 is a connecting strap 30, which is also connected to the friction plate 12 and serves as a longitudinal carrier.

In order to guide the friction plate 12 longitudinally in a well-defined manner, at least one guide strip 32 is attached to the underside 16 of the coach body 18, along which the friction plate 12 deflects in the event of a response. The friction plate 12 itself has an annular friction lining 34, which forms a gap space 36 opposite the underside 16 of the coach body 18. The gap space 36 is connected to the ambient atmosphere via a vent opening 37 and in which ambient pressure prevails.

For this purpose, the gap space 36 is surrounded by the annular friction lining 34 and is sealed off by an annular seal 38 which transmits the pressure differences occurring between the ambient pressure and the internal pressure of the air spring 14. The differential pressure ensured by this configuration guarantees that the friction plate 12 is always loaded with the full pressure of the air spring 14 against the underside 16 of the coach body 18.

Furthermore, supporting or opposing springs 40 are disposed on a concentric pitch circle between the supporting ring 23 and the friction plate 12. The supporting or opposing springs 40 load the friction plate 12 against the underside 16 of the coach body 18 if the air spring 14 is relieved.

Finally, reference numeral 42 designates a compressed-air connection for the air spring 14. Via the compressed-air connection 42, the air spring 14 can be loaded and its respective pressure can be set.

I claim:

1. A rail vehicle apparatus, comprising:

an air-suspended body having an underside;

an air spring connected to said underside and having a base point and an internal air pressure;

a car structure connected to said air spring for supporting said body, said body resting on said car structure and swinging out on said air spring;

an emergency spring connected to said air spring and having a core; and guide and damping devices disposed between said body and said car structure for stabilizing said body at traveling speeds of >100 km/h and suppressing any sway of said body, said guide and damping devices including a friction plate disposed below and loaded against said underside of said body by the internal air pressure of said air spring, said friction plate linked to one of said core of said emergency spring and said base point of said air spring to form a connection to said car structure in a longitudinal direction for suppressing the sway of said body.

2. The rail vehicle apparatus according to claim 1, wherein said underside of said body is movable relative to said air spring bearing against said friction plate for creating friction work, the friction work suppressing the swaying motion of said body.

3. The rail vehicle apparatus according to claim 1, including a connecting strap functioning as a longitudinal carrier, said friction plate connected in an articulated manner to said emergency spring in a transverse direction via said connecting strap.

4. The rail vehicle apparatus according to claim 1, including a vent opening disposed between said underside of said body and said friction plate.

5. The rail vehicle apparatus according to claim 4, wherein said vent opening is formed to provide a full differential pressure between the internal air pressure of said air spring and an ambient air pressure resulting in a contact force between said friction plate and said body.

6. The rail vehicle apparatus according to claim 1, including a sealing device disposed on said friction plate and bearing against said underside of said body for sealing off a gap space enclosed by said sealing device, said gap space formed between said friction plate and said underside of said body.

7. The rail vehicle apparatus according to claim 6, wherein said body, said friction plate, and said emergency spring are disposed such that, if at least one of said air spring and said sealing device enclosing said friction plate fails, said body comes to rest on said emergency spring with said friction plate in between said body and said emergency spring.

8. The rail vehicle apparatus according to claim 1, including an opposing spring for loading said friction plate against the underside of said body if at least one of said air spring and said emergency spring is relieved.

9. The rail vehicle apparatus according to claim 1, wherein said car structure is adapted for bolsterless air-suspended cars.

* * * * *